US007398837B2

(12) United States Patent
Hall et al.

(10) Patent No.: US 7,398,837 B2
(45) Date of Patent: Jul. 15, 2008

(54) DRILL BIT ASSEMBLY WITH A LOGGING DEVICE

(76) Inventors: David R. Hall, 2185 S. Larsen Pkwy., Provo, UT (US) 84606; Francis Leany, 2185 S. Larsen Pkwy., Provo, UT (US) 84606; Christopher J. Durrand, 2185 S. Larsen Pkwy., Provo, UT (US) 84606; Paula Turner, 2185 S. Larsen Pkwy., Provo, UT (US) 84606

( * ) Notice: Subject to any disclaimer, the term of this patent is extended or adjusted under 35 U.S.C. 154(b) by 291 days.

(21) Appl. No.: 11/277,394

(22) Filed: Mar. 24, 2006

(65) Prior Publication Data

US 2007/0114062 A1 May 24, 2007

Related U.S. Application Data

(63) Continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 47/00* (2006.01)
*E21B 49/00* (2006.01)

(52) U.S. Cl. ..... 175/50; 175/40

(58) Field of Classification Search ..... 175/40, 175/50, 39, 327
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 1,821,474 | A | 9/1931 | Mercer |
| 2,054,255 | A | 9/1936 | Howard |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |

(Continued)

*Primary Examiner*—Hoang Dang
(74) *Attorney, Agent, or Firm*—Tyson J. Wilde; Paul M. Schramm

(57) ABSTRACT

In some aspects of the present invention, a drill bit assembly has a body portion intermediate a shank portion and a working portion. The working portion has at least one cutting element. In some embodiments, the drill bit assembly has a shaft with an end substantially coaxial to a central axis of the assembly. The end of the shaft substantially protrudes from the working portion, and at least one downhole logging device is disposed within or in communication with the shaft.

34 Claims, 16 Drawing Sheets

U.S. PATENT DOCUMENTS 2,540,464 A 2/1951 Stokes
2,544,036 A 3/1951 Kammerer
2,575,173 A * 11/1951 Johnson ..... 175/39
2,755,071 A 7/1956 Kammerer
2,901,223 A 8/1959 Scott
2,963,102 A 12/1960 Smith
3,058,532 A * 10/1962 Alder ..... 175/39
3,379,264 A 4/1968 Cox
3,455,158 A * 7/1969 Richter, Jr. et al. ..... 73/152.03
3,493,165 A 2/1970 Schonfield
3,960,223 A 6/1976 Kleine
4,081,042 A 3/1978 Johnson
4,106,577 A 8/1978 Summer
4,307,786 A 12/1981 Evans
4,416,339 A 11/1983 Baker
4,448,269 A 5/1984 Ishikawa
4,531,592 A 7/1985 Hayatdavoudi
4,566,545 A 1/1986 Story
4,962,822 A 10/1990 Pascale
5,009,273 A 4/1991 Grabinski
5,038,873 A 8/1991 Jurgens
5,141,063 A 8/1992 Quesenbury
5,361,859 A 11/1994 Tibbitts
5,417,292 A 5/1995 Polakoff
5,475,309 A * 12/1995 Hong et al. ..... 324/338
5,507,357 A 4/1996 Hult
5,560,440 A 10/1996 Tibbitts
5,568,838 A 10/1996 Struthers
5,678,644 A 10/1997 Fielder
5,720,355 A * 2/1998 Lamine et al. ..... 175/27
5,896,938 A 4/1999 Moeny
6,150,822 A * 11/2000 Hong et al. ..... 324/338
6,202,761 B1 3/2001 Forney
6,439,326 B1 8/2002 Huang
6,467,341 B1 * 10/2002 Boucher et al. ..... 73/152.43
6,533,050 B2 3/2003 Molloy
6,601,454 B1 8/2003 Botnan
6,668,949 B1 12/2003 Rives
6,732,817 B2 5/2004 Dewey
6,929,076 B2 8/2005 Fanuel et al.
6,953,096 B2 10/2005 Glenhill

* cited by examiner

DRILL BIT ASSEMBLY WITH A LOGGING DEVICE

CROSS REFERENCE TO RELATED APPLICATIONS

This application is a continuation in part of U.S. application Ser. No. 11/277,380 filed Mar. 24, 2006, now U.S. Pat. No. 7,337,858 entitled "A Drill Bit Assembly Adapted to Provide Power Downhole", The U.S. application Ser. No. 11/277,380 is a continuation-in-part of U.S. patent application Ser. No. 11/306,976 which was filed on Jan. 18, 2006, now U.S. Pat. No. 7,360,610 and entitled "Drill Bit Assembly for Directional Drilling." U.S. patent application Ser. No. 11/306,976 is a continuation-in-part of Ser. No. 11/306,307 filed on Dec. 22, 2005, now U.S. Pat. No. 7,225,886 entitled Drill Bit Assembly with an Indenting Member. U.S. patent application Ser. No. 11/306,307 is a continuation-in-part of U.S. patent application Ser. No. 11/306,022 filed on Dec. 14, 2005, now U.S. Pat. No. 7,198,119 entitled Hydraulic Drill Bit Assembly. U.S. patent application Ser. No. 11/306,022 is a continuation-in-part of U.S. patent application Ser. No. 11/164,391 filed on Nov. 21, 2005, now U.S. Pat. No. 7,270,196 which is entitled Drill Bit Assembly. All of these applications are herein incorporated by reference in their entirety.

BACKGROUND OF THE INVENTION

The present invention relates to the field of downhole oil, gas, and/or geothermal exploration and more particularly to the field of drill bits for tool strings of such exploration.

Since the beginning of downhole drilling, a lot of time and resources have been invested in developing an optimal drill bit for a downhole tool string. Because of the enormous expense associated with running a drill rig, the operational quality of a drill bit may provide substantial economic benefits.

Today's drill bits generally serve at least two purposes. Using rotary energy provided by the tool string they bore through downhole formations, thus advancing the tool string further into the ground. They also function to dispense drilling mud pumped through the tool string that lubricates parts and washes cuttings and formation material to the surface.

The prior art contains references to drill bits with sensors or other apparatus for data retrieval. For example, U.S. Pat. No. 6,150,822 to Hong, et al discloses a microwave frequency range sensor (antenna or wave guide) disposed in the face of a diamond or PDC drill bit configured to minimize invasion of drilling fluid into the formation ahead of the bit. The sensor is connected to an instrument disposed in a sub interposed in the drill stem for generating and measuring the alteration of microwave energy.

U.S. Pat. No. 6,814,162 to Moran, et al discloses a drill bit, comprising a bit body, a sensor disposed in the bit body, a single journal removably mounted to the bit body, and a roller cone rotatably mounted to the single journal. The drill bit may also comprise a short-hop telemetry transmission device adapted to transmit data from the sensor to a measurement-while-drilling device located above the drill bit on the drill string.

U.S. Pat. No. 6,913,095 to Krueger discloses a closed-loop drilling system utilizes a bottom hole assembly ("BHA") having a steering assembly having a rotating member and a non-rotating sleeve disposed thereon. The sleeve has a plurality of expandable force application members that engage a borehole wall. A power source and associated electronics for energizing the force application members are located outside of the non-rotating sleeve.

BRIEF SUMMARY OF THE INVENTION

In one aspect of the invention, a drill bit assembly has a body portion intermediate a shank portion and a working portion. The working portion has at least one cutting element. The drill bit assembly also has a shaft with an end substantially coaxial to a central axis of the assembly. The second end of the shaft protrudes from the working portion, and at least one downhole logging device is disposed within the shaft.

The logging device of the drill bit assembly may engage a downhole formation. The logging device may also be in communication with a downhole network. In some embodiments, the drill bit assembly comprises a plurality of logging devices disposed within the shaft. At least a portion of the shaft may be electrically isolated from the body portion when resistivity or similar parameters are being sensed. The logging device may comprise a resistivity sensor, an acoustic sensor, hydrophone, an annular pressure sensor, formation pressure sensor, a gamma ray sensor, density neutron sensor, a geophone array, or an accelerometer, directional drilling sensor, an inclination system that may include a gyroscopic device, a drilling dynamics sensor, another system that may be used to evaluate formation properties, an active sensor, a passive sensor, a nuclear source, a gamma source, a neutron source, an electrical source, an acoustic wave source, a seismic source, a sonic source, or combinations thereof.

In another aspect of the invention, a method of downhole data retrieval includes the steps of providing a drill bit assembly having a body portion intermediate a shank portion and a working portion and providing a shaft comprising an end substantially protruding from the working portion, the shaft having at least one downhole logging device. The method includes the additional step of relaying data from the downhole logging device to tool string control equipment.

In an additional step, the method may include engaging a downhole formation with the end of the shaft. The data may be relayed from the downhole logging device to the tool string control equipment through a downhole network and/or logged by a downhole processing element. The method may also include the step of steering the drill bit assembly based on data received from the logging device.

In still another aspect of the invention, a drill bit assembly has a body portion intermediate a shank portion and a working portion. The working portion has at least one cutting element. A shaft has a first end disposed within the body portion and a second end which is substantially coaxial to a central axis of the assembly. The second end of the shaft substantially protrudes from the working portion, and at least one downhole logging device is in communication with the shaft.

The shaft of the drill bit assembly may engage a downhole formation. The downhole logging device may be disposed within the body portion, the working portion, or another area of a tool string. The sensor may be in communication with a downhole network.

DETAILED DESCRIPTION OF THE INVENTION AND THE PREFERRED EMBODIMENT

Figure 1:
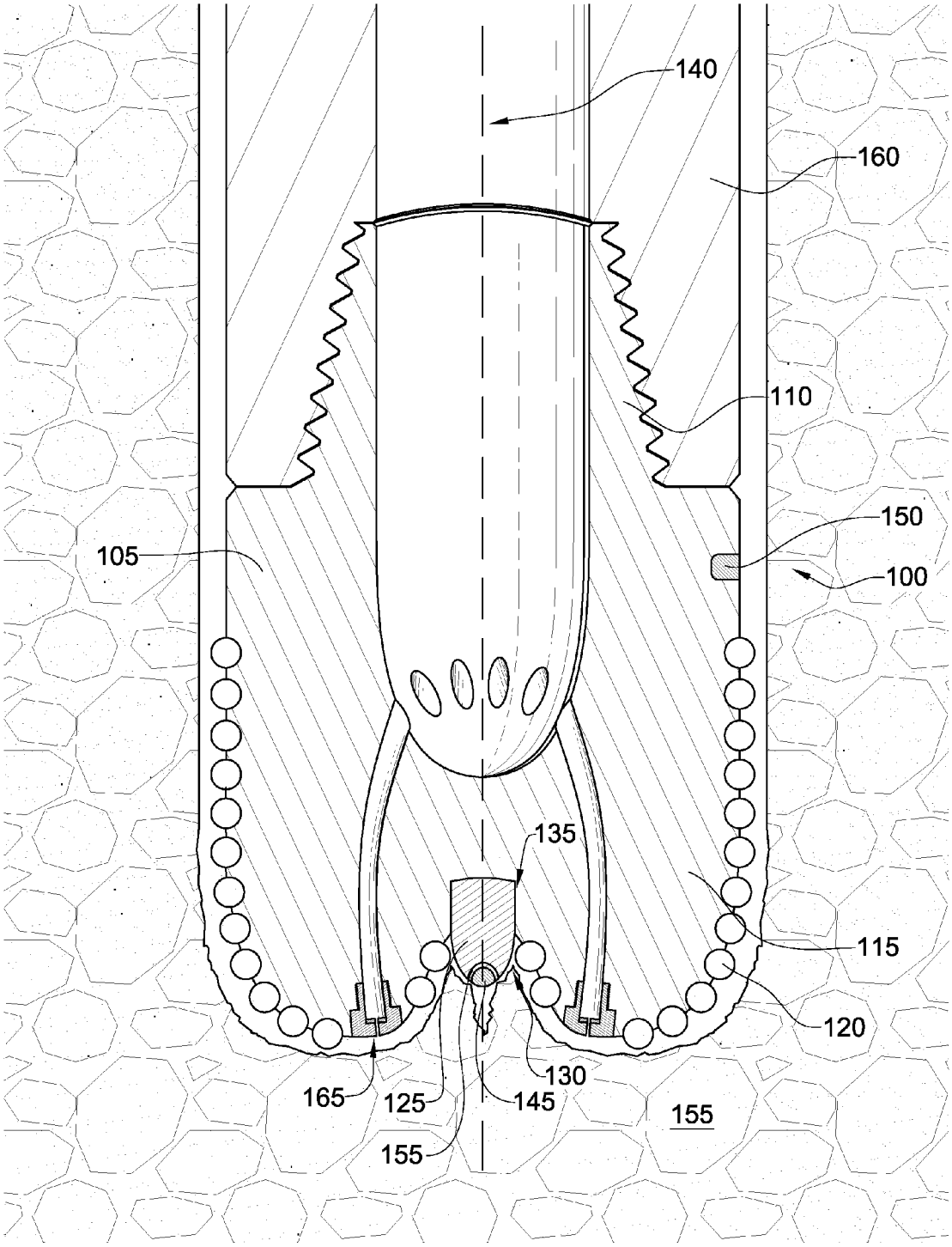
FIG. 1 is a cross-sectional diagram of a drill bit assembly having a shaft with an energy source disposed therein.

Referring now to FIG. 1, a drill bit assembly 100 comprises a body portion 105 intermediate a working portion 115 and a shank portion 110. The shank portion 110 may be threaded to allow interconnection with a downhole tool string 160. The working portion 115 of the drill bit assembly 100 comprises at least one cutting element 120 such as a polycrystalline diamond cutting element.

The drill bit assembly further comprises a shaft 125 having a first end 135 disposed within the body portion and a second end 130 which is substantially coaxial to a central axis 140 of the assembly 100. The second end 130 of the shaft 125 substantially protrudes from the working portion 115. In some embodiments, of the present invention, the shaft may simply be a protrusion formed in the working portion of the drill bit assembly. Fluid channels 165 may allow drilling mud or another fluid to pass through the drill bit assembly 100.

The '022, '391, and '307 U.S. patent applications to David Hall previously cited in the cross reference to related applications section and incorporated into this disclosure, teach many of the mechanical merits of a shaft 125 extending from the working portion 115 of the drill bit assembly 100. For example, working in conjunction with cutting elements 120, the shaft 125 may help to break up rock formations and increase the rate of formation penetration by the drill bit assembly 100. The shaft 125 may also be used to help steer the assembly 100. In addition to these mechanical benefits, considerable data logging benefits may also be realized from the use of a shaft 125 protruding from the working portion 115 of the drill bit assembly 100. This is because the shaft 125 may enable measuring certain attributes of a downhole formation 155 because of its location and because it physically engages the formation 155. The present invention is believed to improve the ability to take downhole measurements, such measurements include at least formation resistivity, salinity, neutron or sonic porosity, natural gamma, pH, formation density, formation pressure, annular pressure, gas, oil or other fluid detection, lithology identification, clay analysis, depth, temperature, formation fracture detection, borehole stability, formation velocity or slowness, or nuclear magnetic resonance NMR.

The shaft 125 may comprise an energy source 145. The energy source may be used in conjunction with a corresponding energy receiver 150 located at a different point on the drill bit assembly 100 or along the tool string. The energy source 145 may be an electric terminal configured to pass a current or a voltage into the downhole formation 155 as it engages the downhole formation 155. The electric current or voltage may then be received at the corresponding energy receiver 150. By regulating the distance between the energy source 145 and the energy receiver 150 and by applying either the current or voltage between the energy source and the receiver, valuable resistivity measurements may be made on the downhole formation 155. In some embodiments, the energy source 145 may be electrically isolated from the energy receiver 150 by a special dielectric layer 125. In other embodiments it may be feasible to electrically isolate the energy source 145 from the energy receiver by electrically isolating the energy receiver 150. The energy source 145 and receiver 150 may function together as a sensor.

In other embodiments, the energy source 145 may be a radioactive source, an emitting device, an acoustic source, passive source, an active source or combinations thereof In other embodiments of the invention, the shaft comprises or is in communication with a sensor a resistivity sensor system, an acoustic sensor system, hydrophone system, an annular pressure sensor system, formation pressure sensor system, a gamma ray sensor system, density neutron sensor system, a geophone array system, or an accelerometer system, directional drilling system, an inclination sensor system that may include a gyroscopic device, a drilling dynamics system, another system that may be used to evaluate formation properties, an active sensor, a passive sensor, or combinations thereof.

Figure 2:
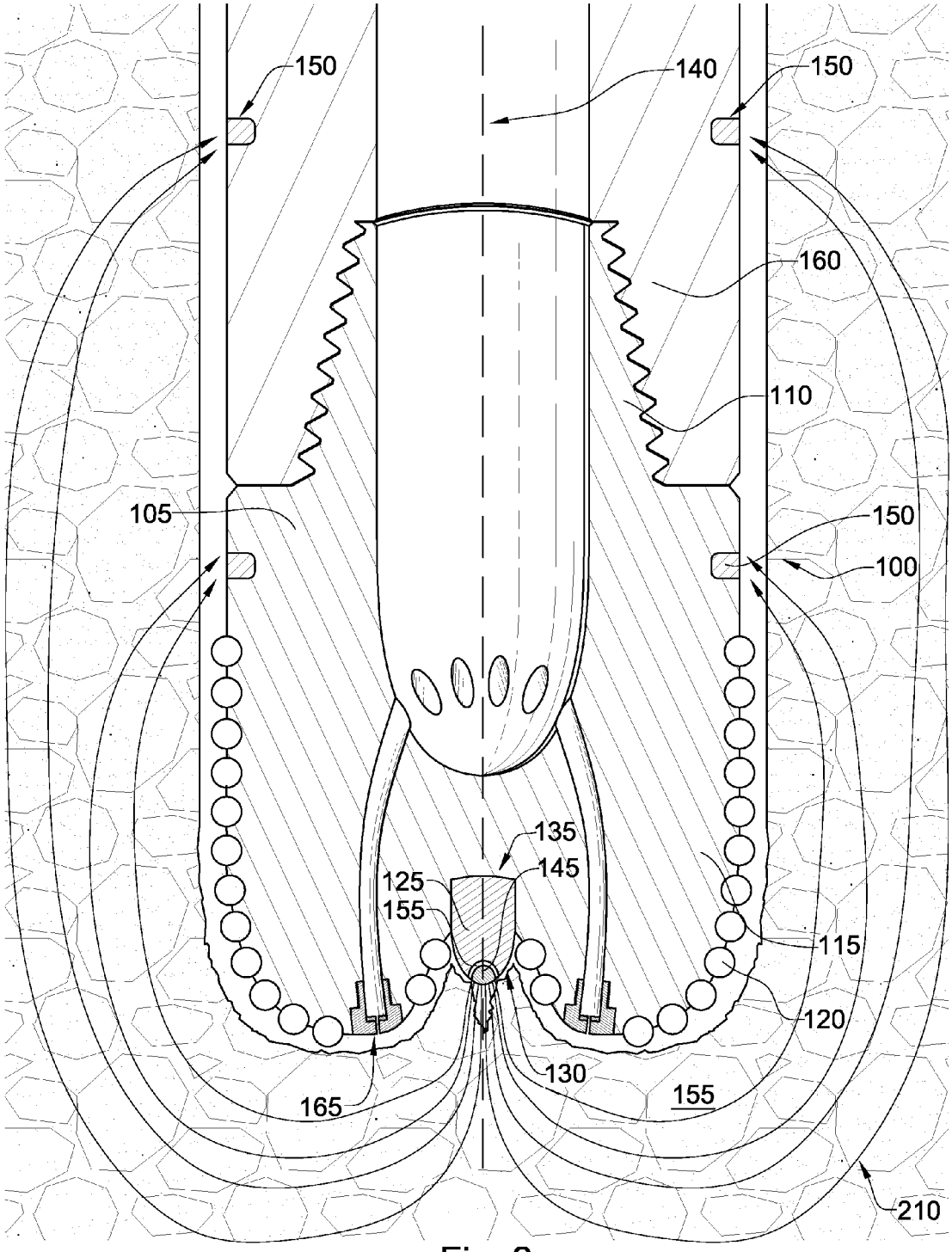
FIG. 2 is a cross-sectional diagram of a drill bit assembly showing possible paths of energy emitted from an energy source.

Referring now to FIG. 2, the assembly 100 comprises a shaft 125 with an energy source 145 disposed in the second end 130 of the shaft. Multiple energy receivers 150 are disposed along the outer edges of the drill bit assembly 100 and the tool string 160. This allows energy emitted from the energy source 145 to be received by the energy receivers 150 at varying distances from the energy source 145. By measuring the differences among the energy received by the energy receivers 150 calculations may be made that characterize the physical properties of the formation 155. In embodiments where the energy emitted from the energy source 145 is electrical current, the path of current may look similar to the lines 210 shown in FIG. 2.

Although not shown in FIG. 2, a bucking current system may be used to manipulate the path electric energy travels. For example the bucking current system may be disposed between the energy source 145 and the at least one receiver 150. A bucking current system may comprise of an additional electric energy source and receiver. The energy passed from the additional electric source to the receiver of the bucking system may repel the energy traveling from energy source 145, forcing the energy to travel deeper into the formation which allows measurements further away from drill bit assembly to be taken. In other embodiments, a bucking current system may be used to confine the travel of the energy to a path closer to the drill bit assembly.

Figure 3:
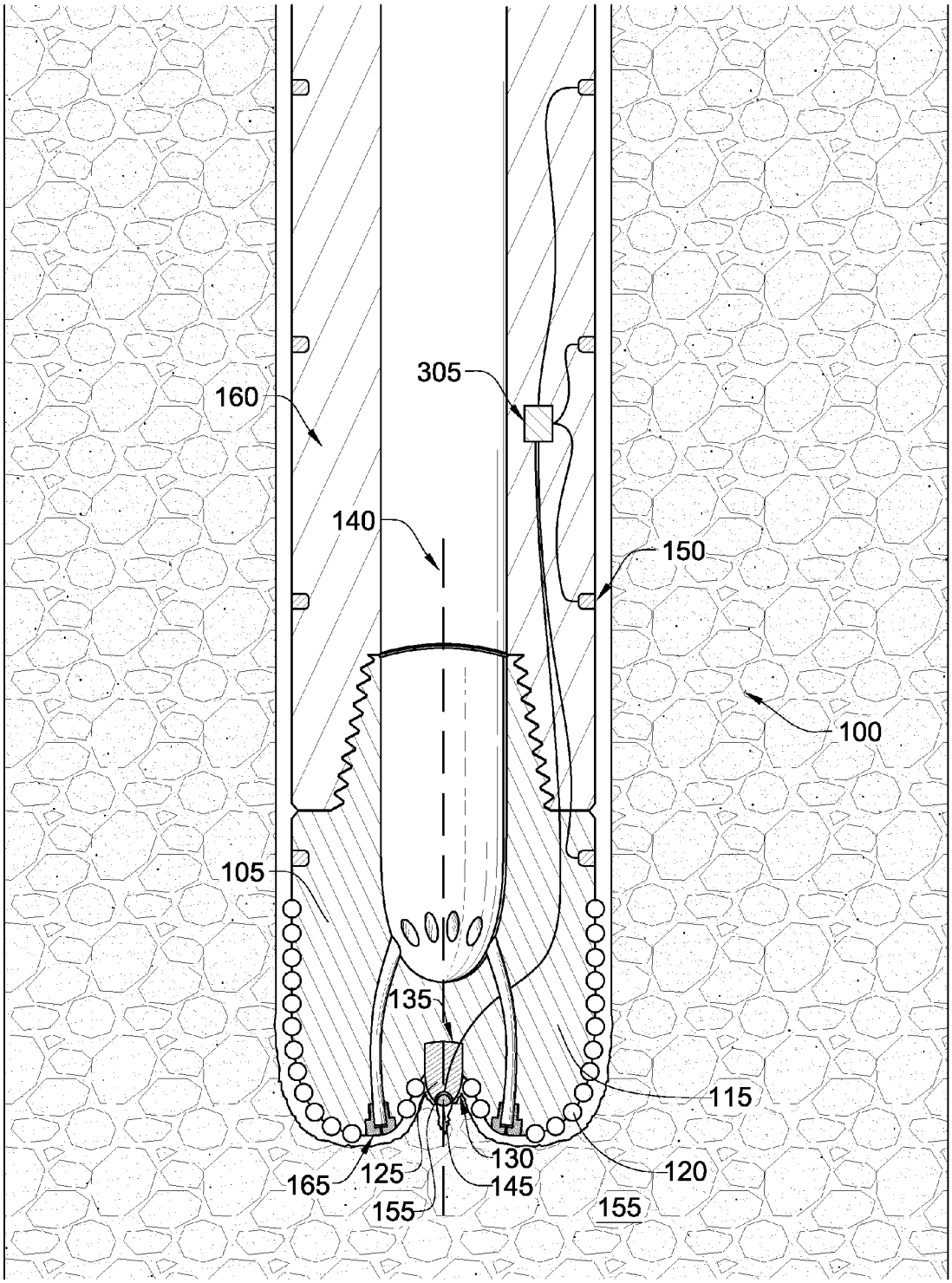
FIG. 3 is a cross-sectional diagram of a drill bit assembly having an energy source and an energy receiver controlled by a downhole processing element.

Referring now to FIG. 3, an energy source 145 and energy receivers 150 may be in communication with a local processing element 305. The processing element 305 may provide the electrical potential between the energy source 145 and the receivers 150 and log measurements taken as data. These data may then be routed to downhole tool string control equipment or to surface equipment to be interpreted. Once interpreted, the drill bit assembly 100 may be controlled according to information provided by the measurements.

Figure 4:
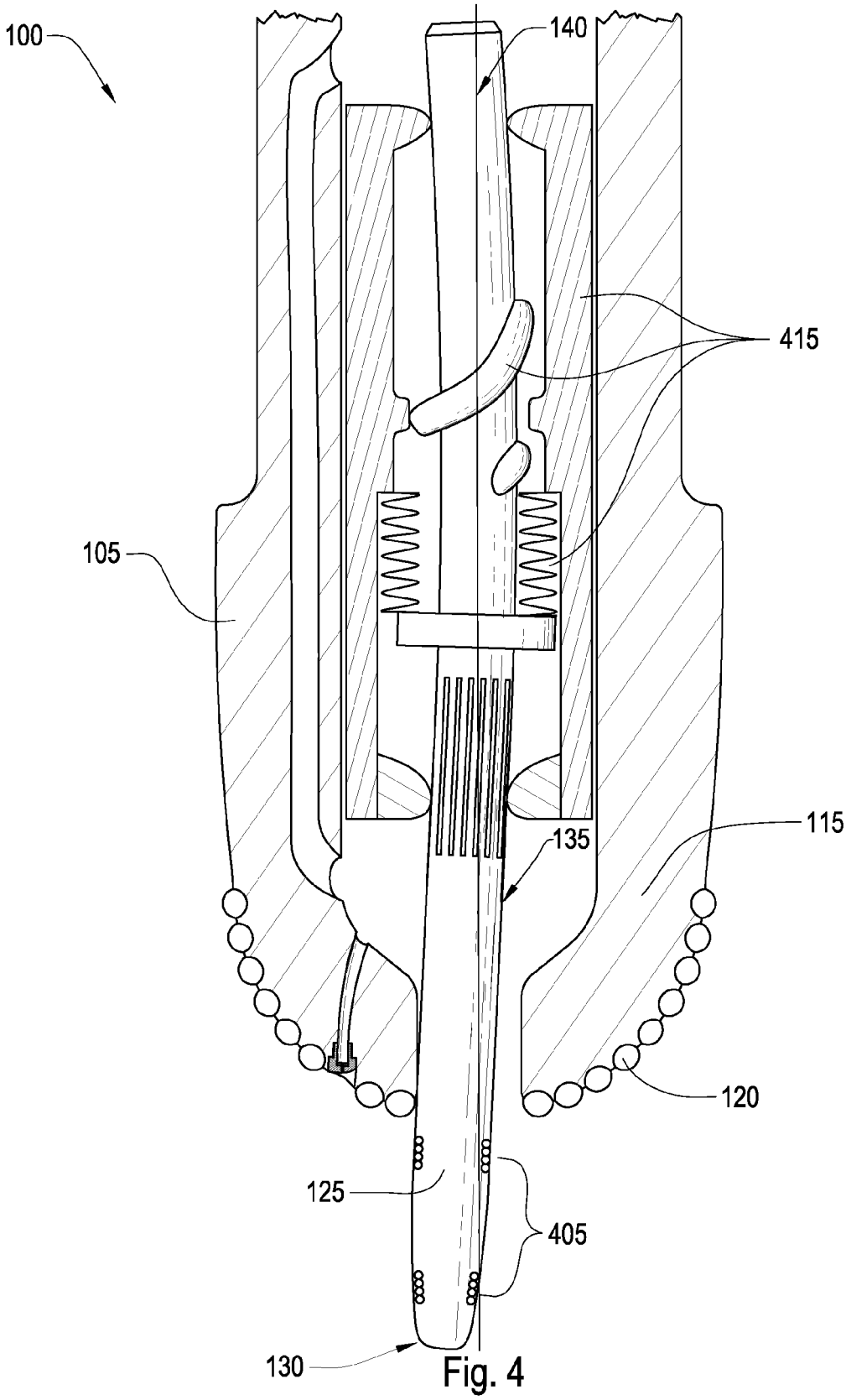
FIG. 4 is a cross-sectional diagram of a drill bit assembly having an elongated shaft and a sensor disposed in the shaft.

Referring now to FIG. 4, another embodiment of a drill bit assembly 100 is shown. In this embodiment, the drill bit assembly comprises a shaft 125 that protrudes substantially from the working portion 115 of the assembly 100. This type of shaft 125 may be used in directional drilling applications that require steering the drill bit assembly 100 during drilling operations. While the shaft 125 is generally coaxial to the central axis 140 of the assembly, steering elements 415 may be used to position the shaft 125 in such a way that a desired trajectory may be followed by the tool string 160 during drilling. In some embodiments, the shaft may comprise an asymmetric geometry which is adapted to rotate independent of the body portion of the drill bit assembly. A brake system may be incorporated into the drill bit assembly or in a downhole tool string component attached to the drill bit assembly. The brake may be adapted to position the asymmetric geometry of the shaft in such a manner as to cause the drill string to travel along a predetermined trajectory. Once the shaft is correctly positioned, the brake may release the shaft which, due to the weight of the tool string loaded to it, will rotationally fix against the formation while the drill bit assembly rotates around the shaft.

In this embodiment, the shaft 125 comprises a sensor 405. While the sensor 405 shown is an induction-type resistivity sensor, in other embodiments the sensor 405 may be a laterolog resistivity sensor, a short normal resistivity sensor, an electromagnetic wave resistivity tool, a nuclear sensor, an acoustic sensor, or a pressure sensor. It is believed that an elongated shaft 125 as shown in this figure may substantially engage the downhole formation 155 and provide data that more accurately represents the characteristics of the formation 155 being drilled.

Figure 5:
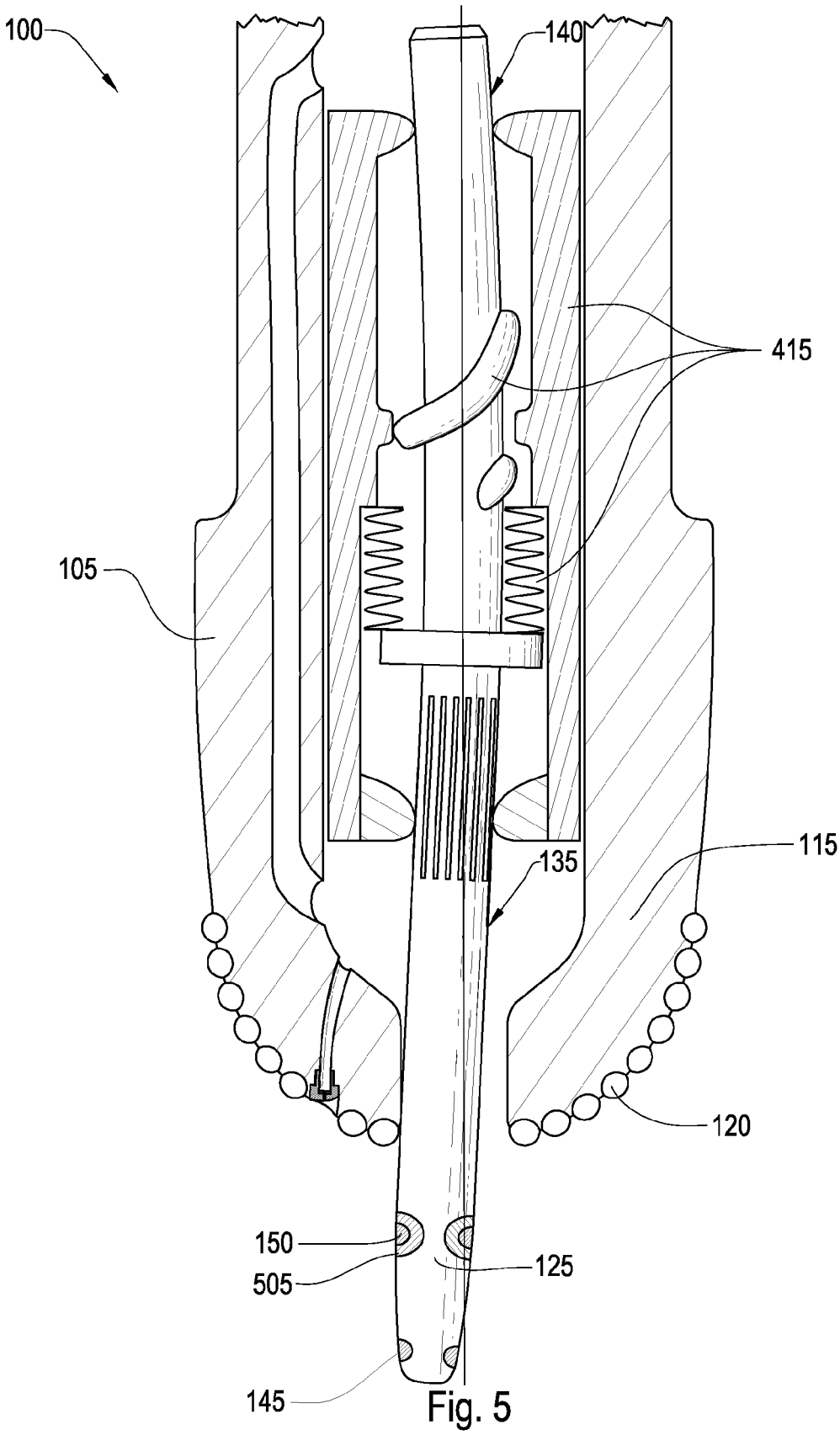
FIG. 5 is a cross-sectional diagram of a drill bit assembly having an elongated shaft and both an energy source and an energy receiver disposed in the shaft.

Referring now to FIG. 5, a drill bit assembly 100 mechanically similar to that of FIG. 4 is shown with the shaft 125 comprising both an energy source 145 and a corresponding energy receiver 150. One or both of the energy source 145 and the energy receiver 150 may be electrically isolated from the other with insulative material 505.

One advantage of such a configuration is that under circumstances in which the shaft 125 engages a downhole formation, the energy emitted from the energy source 145 almost entirely passes through the formation 155 and minimize interference from drilling fluids and other materials used in drilling. The energy source 145 may also be used in conjunction with additional receivers 150 situated further up the downhole tool string 160.

Figure 6:
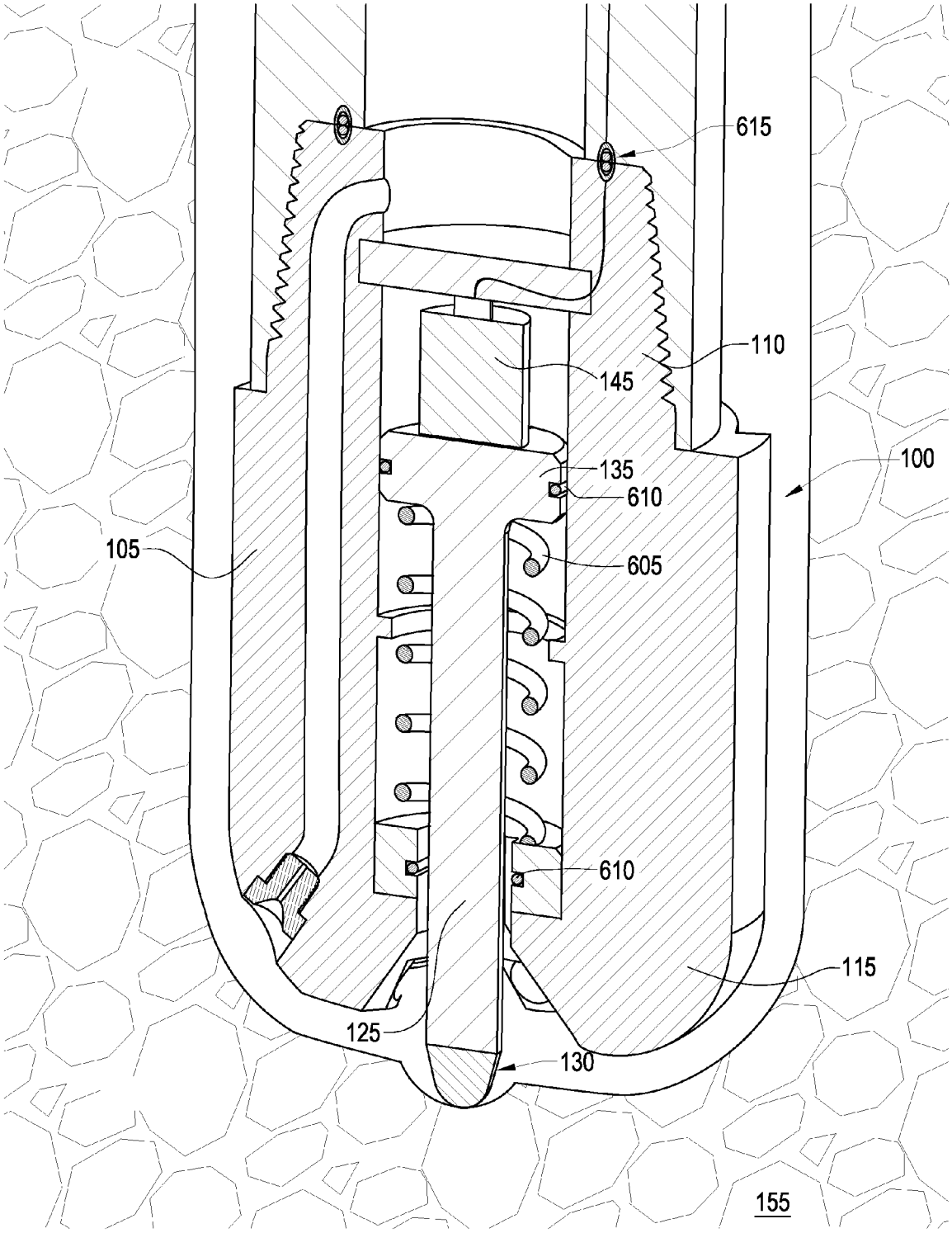
FIG. 6 is a cross-sectional diagram of a drill bit assembly having a shaft with an acoustic energy source.

Referring now to FIG. 6, seismic and sonic measurements may provide very useful information about the composition of downhole formations 155. For this reason, a shaft 125 in the downhole assembly may comprise an energy source 145 that produces acoustic energy. In the embodiment shown, the energy source 145 is a piezoelectric device in communication with the shaft 125. The piezoelectric device is adapted to create and pass an acoustic signal through the shaft 125 and into the downhole formation 155, after which reflected portions of the acoustic signal may be received by energy receivers 150 disposed along the tool string 160 or positioned at surface. Preferably, the acoustic source is adapted to produce a signal comprising multiple frequencies. The acoustic energy source 145 may be in communication with downhole and/or surface control equipment which provide an electrical signal which is converted into the acoustic signal. Such sources may comprise piezoelectric or magnetostrictive elements. The control equipment may be in communication with the source through electrically conductive medium. For example, a coaxial cable, wire, twisted pair of wires or combinations thereof may be secured within both the drill bit assembly and at least a downhole tool string component connected to the drill bit assembly. The medium may be in inductive or electrical communication with each other through couplers 615 positioned so as to allow signal transmission across the connection of the downhole component and the drill bit assembly. The couplers may be disposed within recesses in either primary or secondary shoulder of the connection or they may be disposed within inserts positioned within the bores of the drill bit assembly and the downhole tool string component. In other embodiments, acoustic energy may be emitted from the shaft 125 using hydraulic or other mechanical means.

The embodiment shown in FIG. 6 may improve drilling dynamics by stabilizing the drill bit assembly and also helping to control the weight loaded to the working portion. The shaft 125 may be controlled hydraulically, electrically, or mechanically to move vertically with respect to the drill bit assembly 100. A shock absorbing spring 605 and bearings 610 may also aid in the mechanical functionality of the shaft 125.

The embodiment of in FIG. 6 may also be operated in a passive mode where vibrations, shocks caused by drilling or some other acoustic energy source (such as from the surface or a cross well operation) may vibrate the shaft. Such vibrations may be converted by a piezoelectric or magnetostrictive element into electric signals. These signal may provide information about the physical properties of the rocks ahead of, around or above the working portion.

Figure 7:
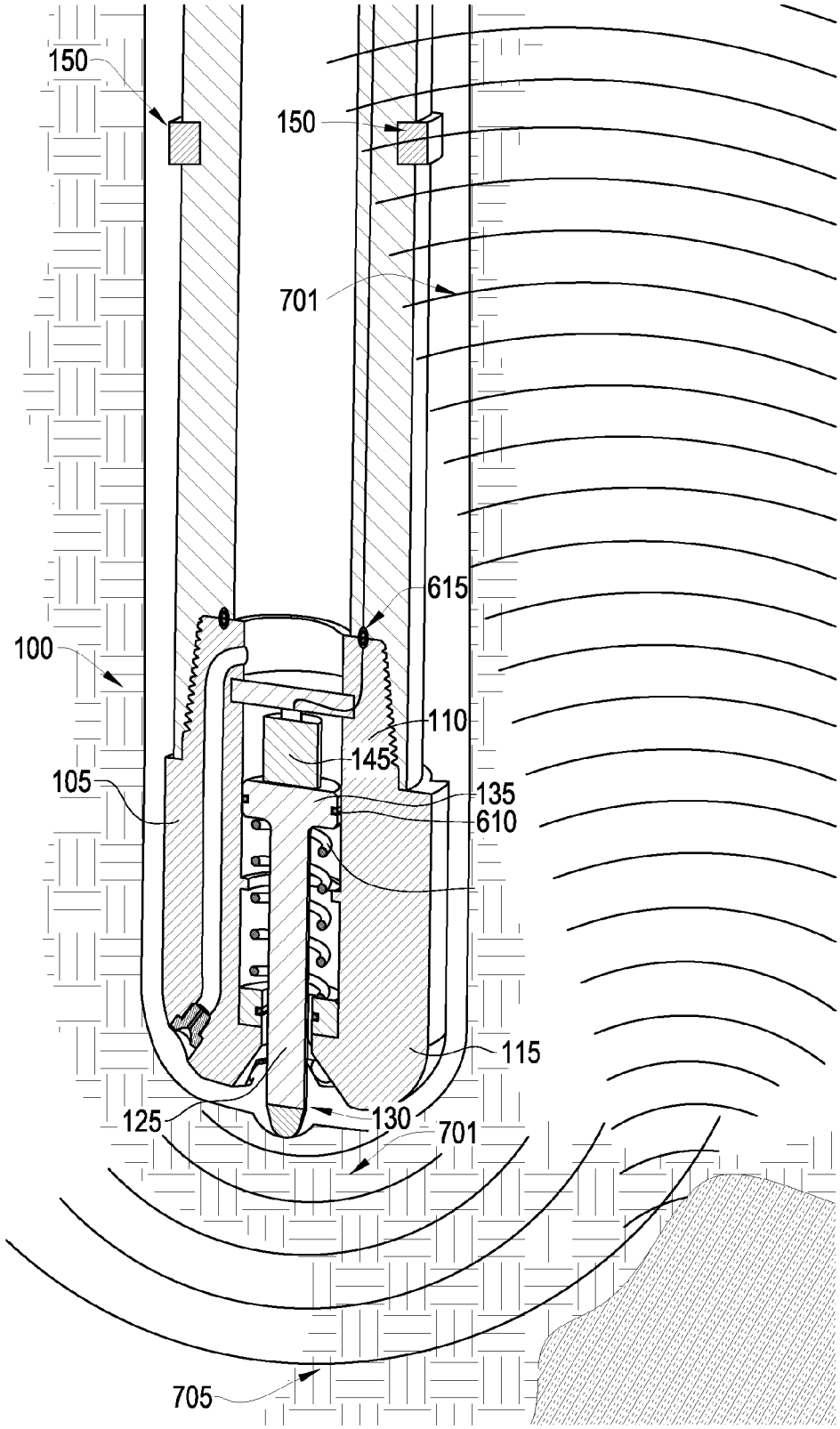
FIG. 7 is a cross-sectional diagram of a drill bit assembly showing possible paths of energy emitted at the shaft.
Figure 8:
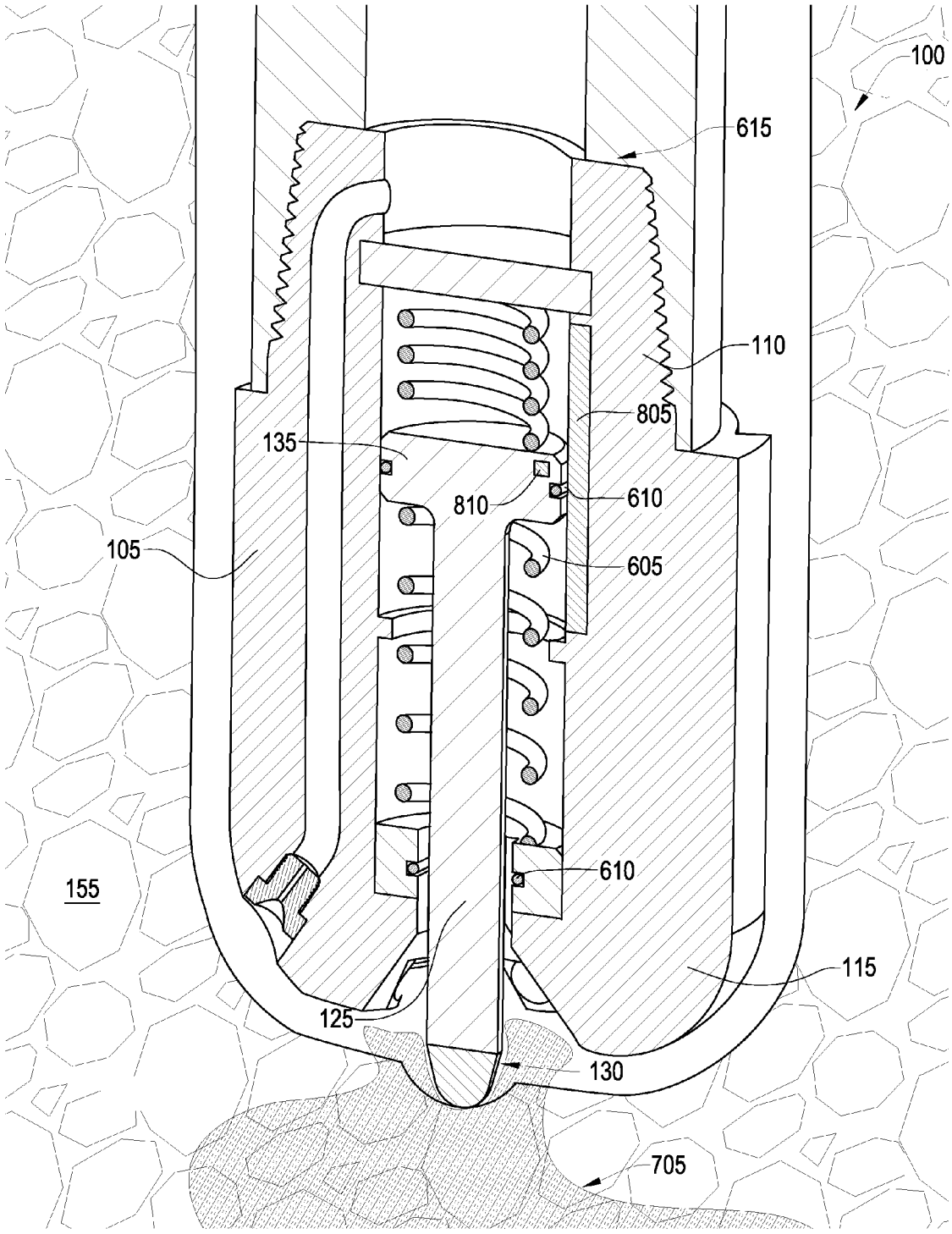
FIG. 8 is a cross-sectional diagram of another drill bit assembly having a pressure sensor disposed within a shaft.

Referring now to FIG. 7, acoustic waves 701 emitted from the shaft 125 are shown reaching an acoustic impedance boundary 705. Acoustic impedance boundaries 705 may be a result from a feature in the formation such as a fault, a salt body, change in formation hardness, change in formation material, a hydrocarbon formation, or other changes in the formation. Acoustic waves reflect off of such acoustic impedance boundaries 705 and may be sensed by energy receivers 150 at the surface, in the tool string 160, the drill bit assembly and/or in the shaft. Physical attributes of acoustic boundaries 705 such as its spatial location and dimensional or surface attributes, acoustic properties and composition may be realized by interpreting the waves received by the energy receivers 150. These attributes may then be used to direct the tool string 160 in the most beneficial manner with respect to the acoustic boundaries 705. Although not shown in FIG. 7, an acoustic wave may be produced at the surface or at another location on the tool string and reflect off of the acoustic impedance boundary and be received by energy receivers in the shaft Referring now to FIG. 8, the drill bit assembly 100 may comprise a pressure sensor adapted to measure the compressive strength of the formation 805. The pressure sensor 805 may be in communication with the shaft 125 or be disposed within the shaft. In this particular embodiment, a high strength formation 155 is being penetrated by the drill bit assembly 100 and the strength of the formation 155 causes the shaft 125 to be pushed up into the drill bit assembly 100 and compress the spring 605. The spring 605 may be fairly resilient such that a significant amount of pressure may be required to compress it. The sensor 805 shown is a position sensor that may sense the position of the shaft 125. Such a sensor may include magnets, hall-effect elements, piezoelectric elements, magnetostrictive elements, capacitive elements or combinations thereof. In this embodiment, the position of the shaft 125 may be indicative of the pressure of the formation 155. The sensor 805 may track the position of the shaft 125, but in some embodiments a small tracking device 810 on the shaft 125 may provide more accurate measurements. In some embodiments, a strain sensor may used to measure the strain in the shaft, spring, or both.

Figure 9:
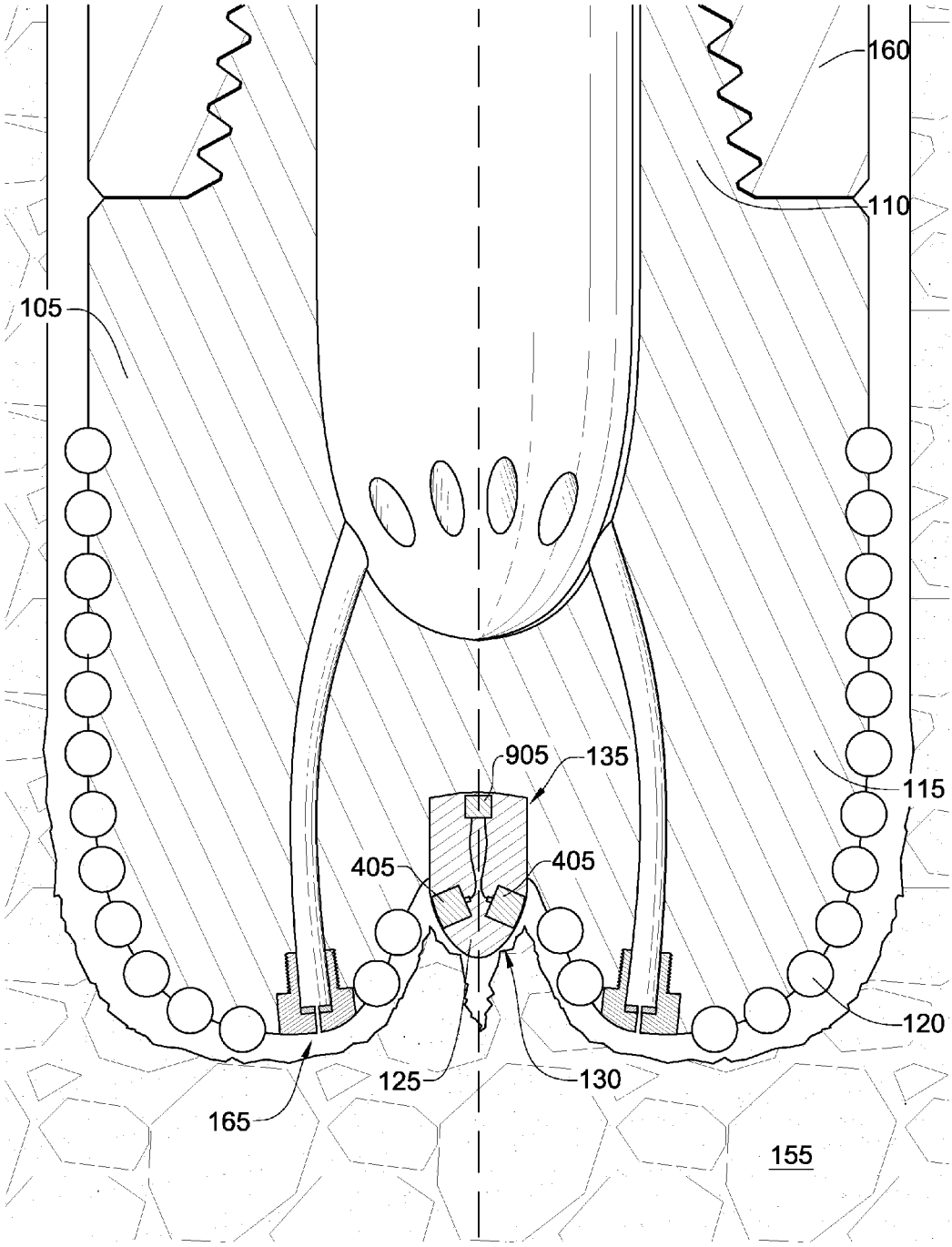
FIG. 9 is a cross-sectional diagram of another embodiment of a drill bit assembly having acoustic sensors disposed within a shaft.

Referring now to FIG. 9, sensors 405 disposed within the shaft of a drill bit assembly 100 may be acoustic sensors such as geophones. Acoustic sensors may be particularly useful for seismic and sonic wave measurements. In some embodiments, an acoustic source may generate a great deal of acoustic energy at the surface of the earth. The acoustic energy then propagates through the earth until it reaches the acoustic sensors. As the waveform of the acoustic energy received at the various sensors 405 may be indicative of the physical characteristics of the formation 155 being drilled, it may be particularly useful to have acoustic sensors disposed in the shaft 125 that engages the downhole formation 155. Sensors may not be limited to being positioned in the shaft but may additionally be positioned elsewhere on the tool string as part an array.

In other embodiments an acoustic signal may be generated downhole through acoustic sources disposed in the drill bit assembly 100 or other locations on the tool string 160. The acoustic signal may also come from another well bore, or in some embodiments, the acoustic signal may be generated by the vibrations in the earth generated as the drill bit assembly advances in the earth. In yet another embodiment, the acoustic signal may be generated by the process of pressurizing and fracturing the formation along weakness in the formation. In such an embodiment, the bore hole may be pressurized to an extent that the formation breaks at its weakest points. The vibrations generated by the fracturing of the formation may be recorded by the sensors 405. The sensors 405 may be in communication with a local storage module 905 that may log their data and/or provide them with electrical power. The control module 905 may communicate with tool string control equipment to assist in planning the trajectory of the tool string 160.

Figure 10:
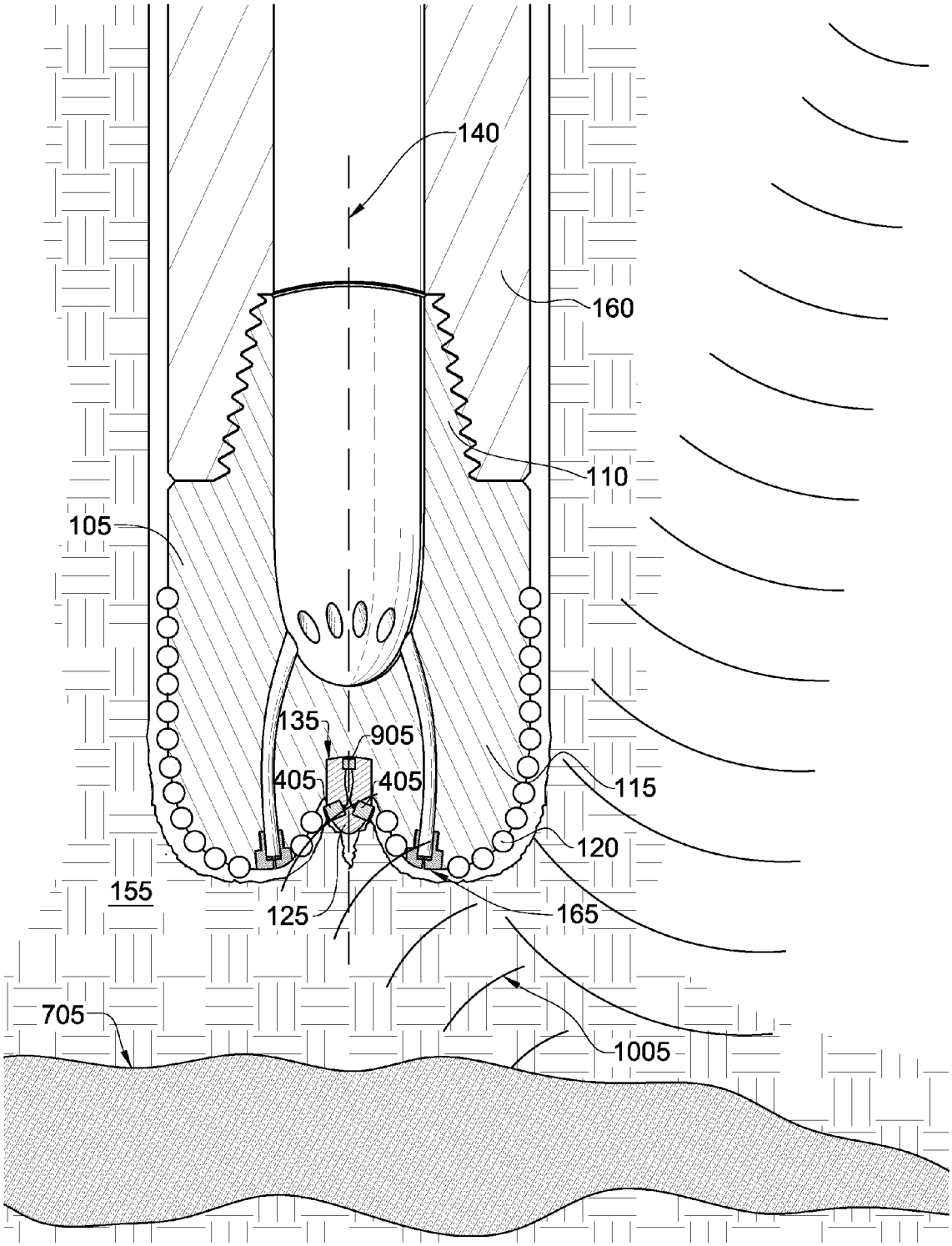
FIG. 10 is a cross-sectional diagram a drill bit assembly showing possible paths of acoustic energy being detected at the shaft.

FIG. 10 shows a cross-sectional view of the drill bit assembly with acoustic waves 1005 reflected off of an acoustic impedance boundary 705 that is ahead of or otherwise proximal to the bit and being received by the sensors 405 in the shaft, along the tool string, or at the surface. In other embodiments of the invention, sensors 405 may sense gamma rays, radioactive energy, resistivity, torque, pressure, or other drilling dynamics measurements or combinations thereof from the downhole formation 155 being drilled.

Figure 11:
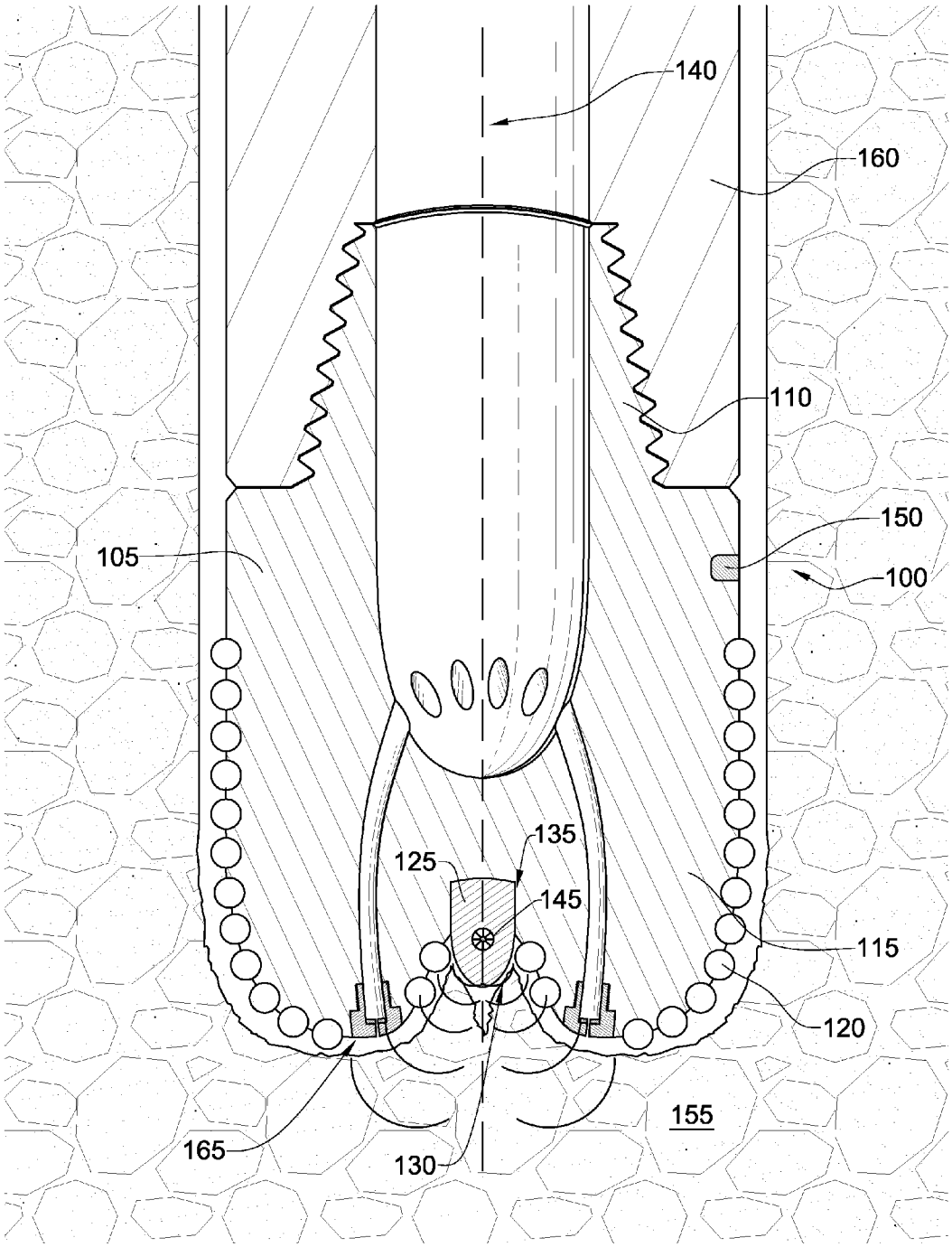
FIG. 11 is a cross-sectional diagram of another embodiment of a drill bit assembly comprising a radioactive energy source in the shaft.

Referring now to FIG. 11, in some embodiments of the invention, it may be beneficial for a drill bit assembly 100 to comprise a shaft 125 with an energy source 145 that is radioactive or emits subatomic particles. Examples of such sources include active gamma sources and neutron sources. At least one energy receiver 150 may be disposed within the drill bit assembly 100 and receive the radioactive energy or subatomic particles that are transmitted through the downhole formation 155. In some embodiments of the invention, the energy source may be disposed within the drill bit assembly, tool string, or at the surface and the sensor is disposed in or in communication with the shaft. In some embodiments, the gamma source may be cesium 137. The neutron source may comprise an Americium Beryllium source or it may comprise a pulsed neutron generator which uses deuterium and/or tritium ions. In other embodiments, the gamma or neutron source may be disposed within the body of the drill bit assembly.

Figure 12:
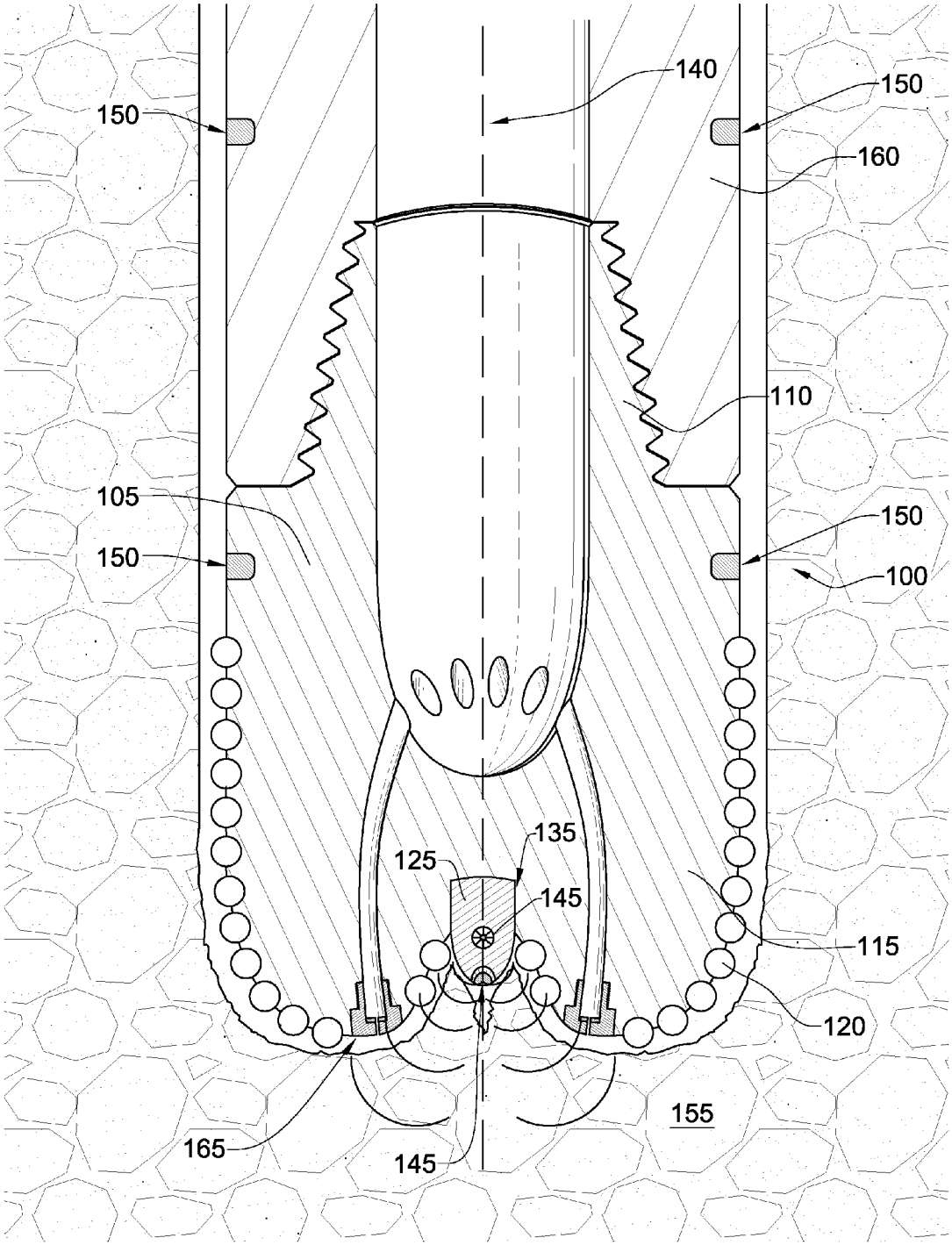
FIG. 12 is a cross-sectional diagram of another embodiment of a drill bit assembly comprising a radioactive energy source together with another energy source in the shaft.

Referring now to FIG. 12, the drill bit assembly 100 may comprise multiple energy sources 145 in the shaft 125. For example, the shaft 125 may comprise a gamma ray source in addition to an electrical current source. Corresponding energy receivers 150 may work in conjunction with the energy sources 145 to provide gamma and resistivity measurements, respectively.

Figure 13:
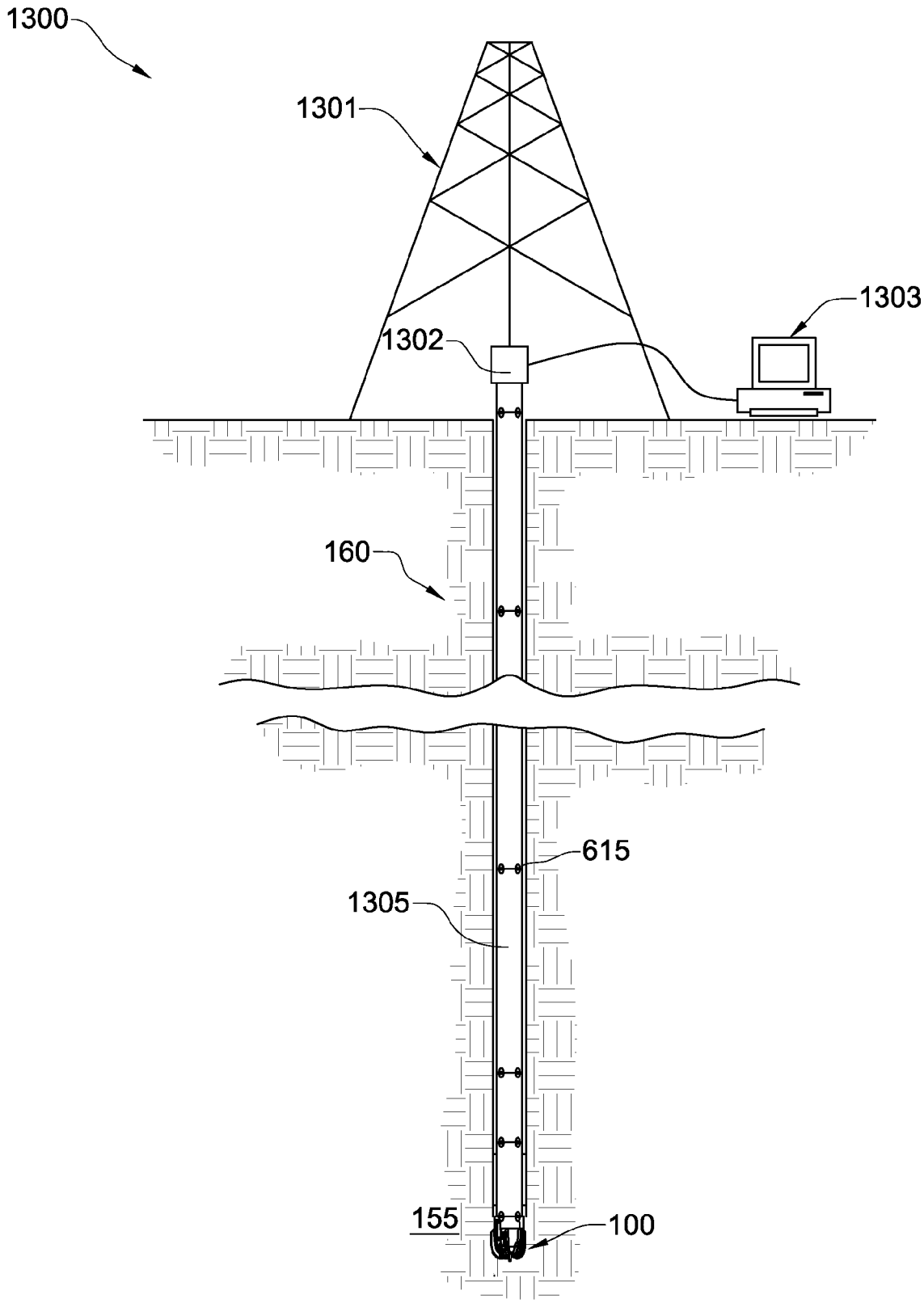
FIG. 13 is a perspective diagram of one possible data transmission system that may be used in conjunction with the present invention.

A drill bit assembly 100 according to the present invention may be in communication with one or more tools in a network. Referring now to FIG. 13, a downhole network 1300 may comprise one or more downhole tool string components 1305 linked together in a tool string 160 and in communication with surface equipment 1303. Data may be transmitted up and down the tool string 160 and between different tool components 1305.

The tool string 160 may be suspended by a derrick 1301. Data may be transmitted along the tool string 160 through techniques known in the art. A preferred method of downhole data transmission using inductive couplers disposed in tool joints is disclosed in the U.S. Pat. No. 6,670,880 to Hall, et al, which is herein incorporated by reference for all it discloses. An alternate data transmission path may comprise direct electrical contacts in tool joints such as in the system disclosed in U.S. Pat. No. 6,688,396 to Floerke, et al., which is herein incorporated by reference for all that it discloses. Another data transmission system that may also be adapted for use with the present invention is disclosed in U.S. Pat. No. 6,641,434 to Boyle, et al., which is also herein incorporated by reference for all that it discloses. In some embodiments, of the present invention alternative forms of telemetry may be used to communicate with the drill bit assembly, such as telemetry systems that communicate through the drilling mud or through the earth. Such telemetry systems may use electromagnetic of acoustic waves. The alternative forms of telemetry may be the primary telemetry system for communication with the drill bit assembly or they may be back-up systems designed to maintain some communication if the primary telemetry system fails.

A data swivel 1302, or a wireless top-hole data connection may facilitate the transfer of data between the rotatable tool string 160 and the stationary surface equipment 1303. Downhole tool string components 1305 may comprise drill pipes, jars, shock absorbers, mud hammers, air hammers, mud motors, turbines, reamers, under-reamers, fishing tools, steering elements, MWD tools, LWD tools, seismic sources, seismic receivers, pumps, perforators, packers, other tools with an explosive charge, and mud-pulse sirens.

Having a network 1300 in the tool string 160 may enable high-speed communication between each device connected to it and facilitate the transmission and receipt of data between sensors 405, energy sources 145, and energy receivers 150 in the shaft 125 of the drill bit assembly 100.

Figure 14:
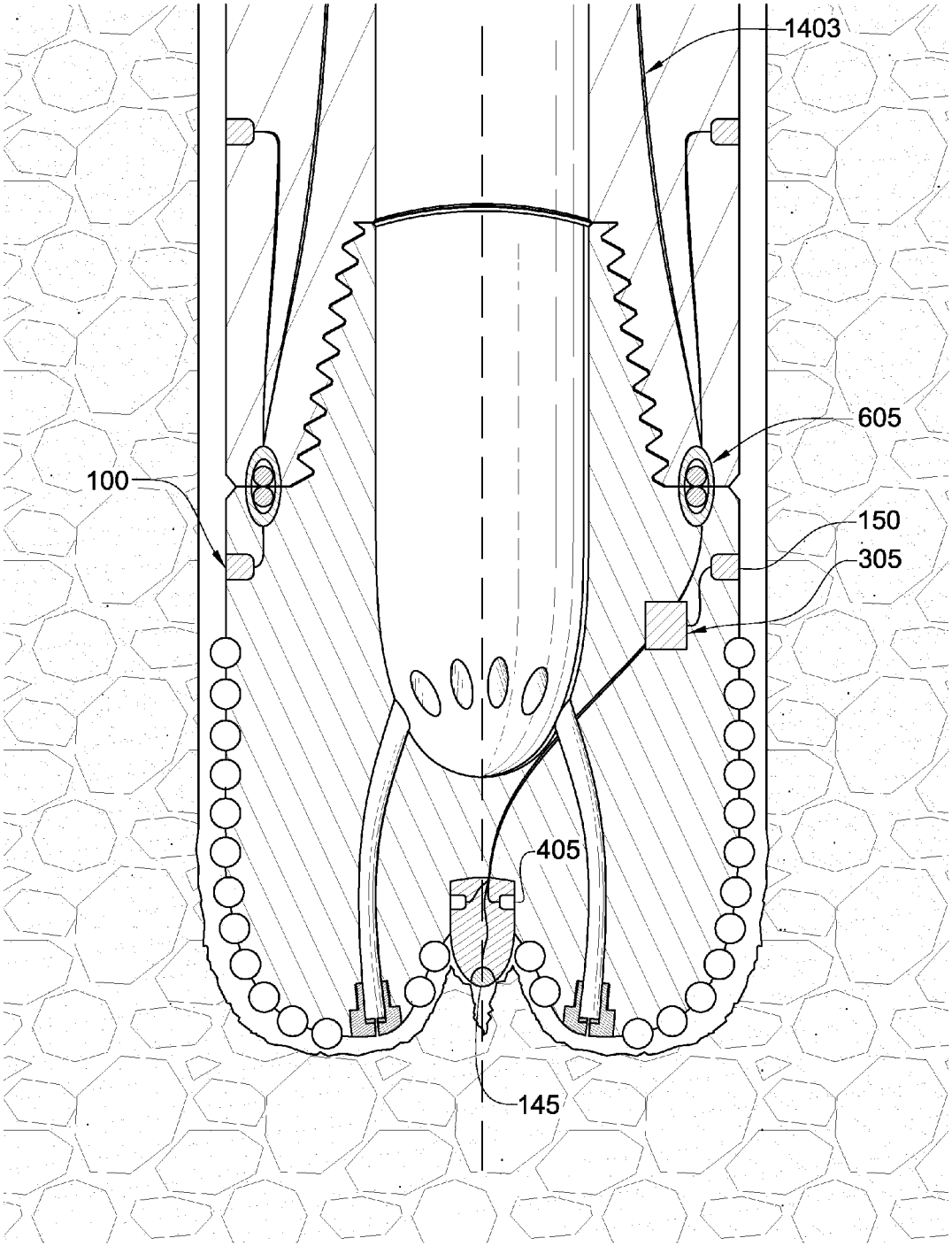
FIG. 14 is a cross-sectional diagram of a drill bit assembly having energy sources and receivers operably connected to a data transmission system.

Referring now to FIG. 14, a drill bit assembly 100 with an energy source 145, energy receivers 150, and sensors 405 designed to operate in a downhole network 1300 is shown. The energy source 145 and sensors 405 are disposed within the shaft 125. A processing element 305 may control the energy source 145, their corresponding energy receivers 150, and the sensors 405. The processing element 305 may also serve to log data received or interpret measurements from the energy receivers 150 or the sensors 405. The processing element 305 may be in communication with the downhole network 1300 through a system of inductive couplers 615 and coaxial cable 1403 disposed within the tool string 160 as has been previously discussed.

Figure 15:
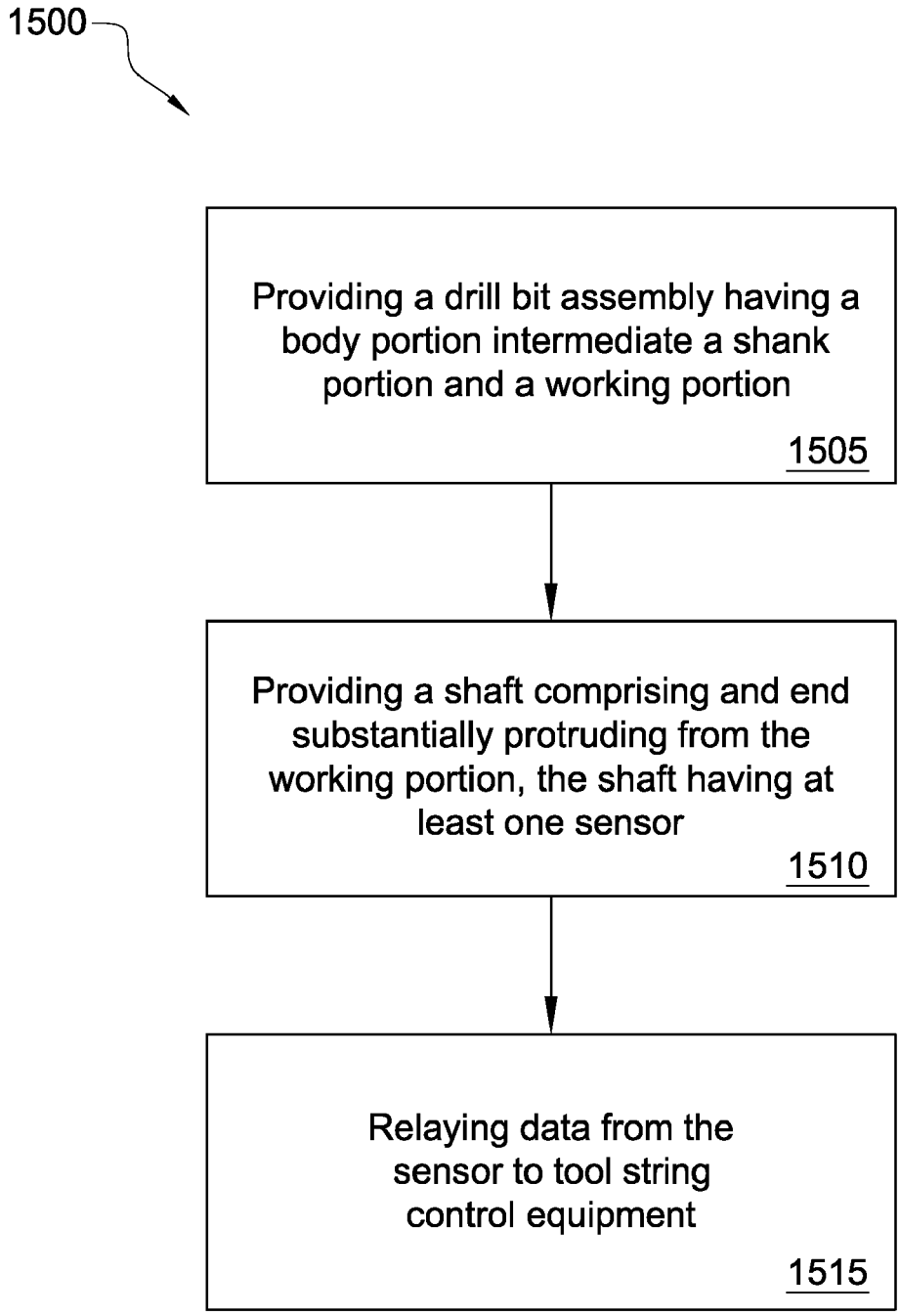
FIG. 15 is a flowchart diagram of a method of downhole data retrieval.

Referring now to FIG. 15, a method 1500 of downhole data retrieval comprises the steps of providing 1505 a drill bit assembly having a body portion intermediate a shank portion and a working portion, providing 1510 a shaft comprising an end substantially protruding from the working portion, the shaft having at least one sensor, and relaying 1515 data from the sensor to tool string control equipment.

The method 1500 may include the step of engaging a downhole formation with the end of the shaft. This may provide optimal measurements and/or data from the sensor disposed within the shaft. The data may be relayed 1515 from the sensor to tool string control equipment such as downhole intelligent steering equipment or surface control equipment through a downhole network. The tool string control equipment may then change drilling parameters according to the data received to optimize drilling efficiency. For example, the drill bit assembly may be steered according to data received from the sensor.

The data may also be logged in a local storage module for later retrieval or delayed transmission to tool string control equipment.

Figure 16:
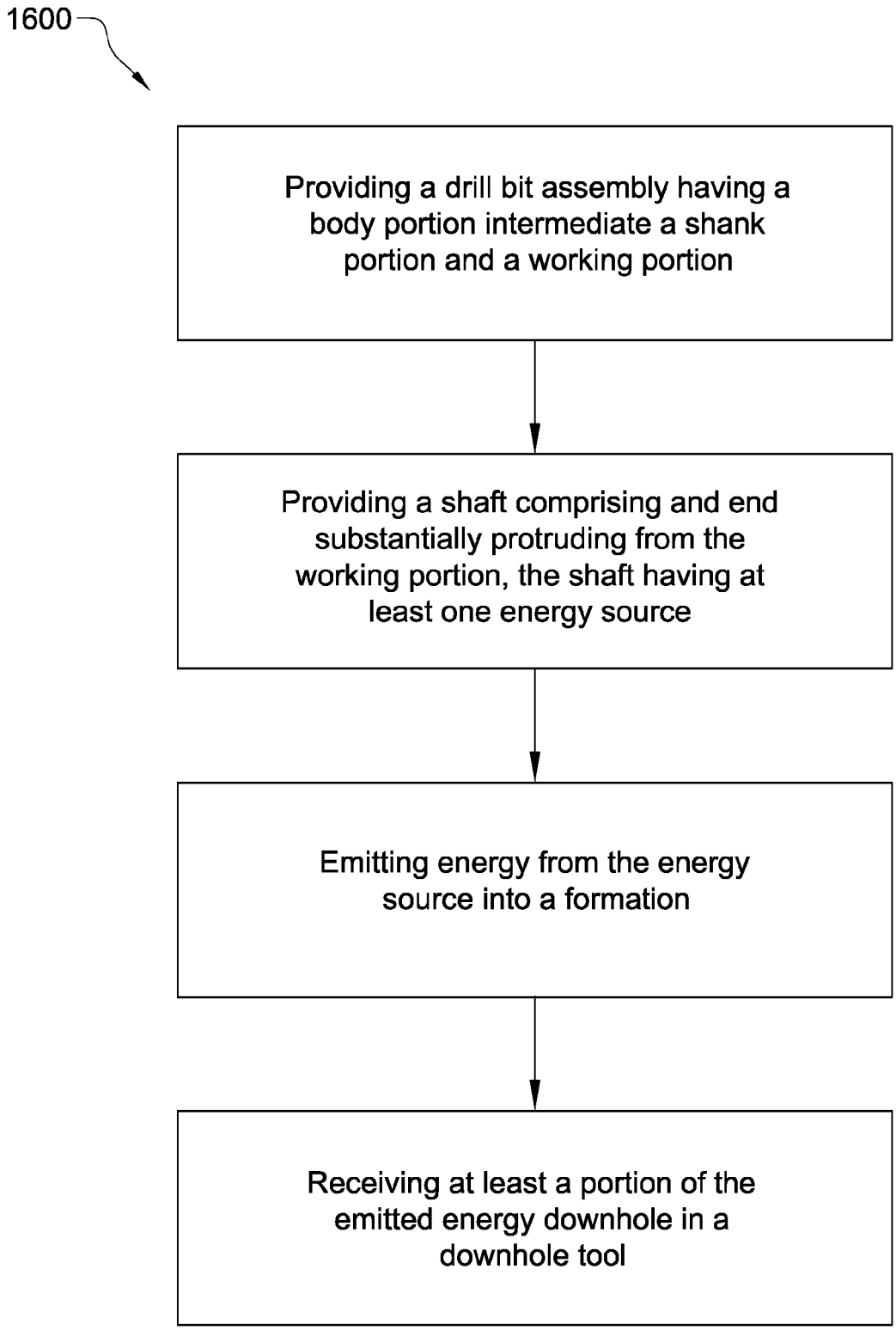
FIG. 16 is a flowchart diagram showing another method of downhole data retrieval.

Referring now to FIG. 16, another method 1600 of downhole data retrieval comprises the steps of providing 1605 a drill bit assembly having a body portion intermediate a shank portion and a working portion, providing 1610 a shaft comprising an end substantially protruding from the working portion, the shaft having at least one energy source, emitting 1615 energy from the energy source into a formation and receiving 1620 at least a portion of the emitted energy downhole in a downhole tool.

The method 1600 may also include the step of engaging a downhole formation with the end of the shaft. The portion of the emitted energy received 1620 in the downhole tool may be used to sense parameters of the formation, such as resistivity, composition, physical dimensions, and other properties. The portion of emitted energy received 1620 may also be logged as data and be stored in a local storage module such as a processing element. Other properties of the energy received 1620 may also be logged as data such as distortions or transformations in waveforms.

The data may be sent to tool string control equipment through a downhole network. As in the method 1500 of FIG. 16, the tool string control equipment may then change drilling parameters according to the data received to optimize drilling efficiency. The method 1600 may include the step of steering the drill bit assembly based on the data.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body portion intermediate a shank portion and a working portion;

the working portion comprising at least one cutting element;

an end of an shaft protruding from the working portion, the shaft being adapted to engage a downhole formation; and at least one downhole logging device disposed within the shaft.

2. The drill bit assembly of claim 1, wherein the downhole logging device comprises a sensor, a transceiver, an energy source, or combination thereof.

3. The drill bit assembly of claim 1, wherein the downhole logging device engages the downhole formation.

4. The drill bit assembly of claim 1, wherein the downhole logging device is in communication with a downhole network.

5. The drill bit assembly of claim 1, further comprising a plurality of downhole logging devices disposed within the shaft.

6. The drill bit assembly of claim 1, wherein at least a portion of the shaft is electrically isolated from the body portion.

7. The drill bit assembly of claim 1, wherein the downhole logging device comprises a resistivity sensor.

8. The drill bit assembly of claim 1, wherein the downhole logging device comprises a seismic and/or a sonic sensor.

9. The drill bit assembly of claim 1, wherein the downhole logging device comprises a compressive strength sensor.

10. The drill bit assembly of claim 1, wherein the downhole logging device comprises a gamma sensor.

11. The drill bit assembly of claim 1, wherein the downhole logging device comprises at least one accelerometer.

12. The drill bit assembly of claim 1, wherein the downhole logging device comprises a drilling dynamics sensor.

13. The drill bit assembly of claim 1, wherein the downhole logging device comprises a current source.

14. The drill bit assembly of claim 1, wherein the downhole logging device comprises at least part of a resistivity measuring device.

15. The drill bit assembly of claim 1, wherein the downhole logging device comprises an acoustic source.

16. The drill bit assembly of claim 15, wherein the acoustic source comprises a piezoelectric element.

17. The drill bit assembly of claim 16, wherein the acoustic source generates a seismic and/or sonic signal.

18. The drill bit assembly of claim 1, wherein the downhole logging device comprises a gamma source.

19. The drill bit assembly of claim 1, wherein the downhole logging device comprises a neutron source.

20. The drill bit assembly of claim 1, wherein the shaft is protrusion formed in the working portion of the assembly.

21. The drill bit assembly of claim 1, wherein the shaft is substantially coaxial with a central axis of the drill bit assembly.

22. A method of downhole data retrieval comprising the steps of providing a drill bit assembly having a body portion intermediate a shank portion and a working portion;

providing a shaft comprising an end substantially protruding from the working portion, the shaft having at least one downhole logging device, the shaft being adapted to engage a downhole formation; and relaying data from the downhole logging devices to tool string control equipment.

23. The method of claim 22, wherein the data are relayed from the downhole logging device to tool string control equipment through a downhole network.

24. The method of claim 22, further comprising the step of steering the drill bit assembly based on data received from the sensor.

25. The method of claim 22, wherein the shaft is protrusion formed in the working portion of the assembly.

26. A drill bit assembly, comprising:

a body portion intermediate a shank portion and a working portion;

the working portion comprising at least one cutting element;

a shaft comprising an end substantially protruding from the working portion, the shaft being adapted to engage a downhole formation; and at least one downhole logging device in communication with the shaft.

27. The drill bit assembly of claim 26, wherein the downhole logging device comprises a sensor, a transceiver, an energy source, or combination thereof.

28. The drill bit assembly of claim 26, wherein the downhole logging device is disposed within the body portion, the working portion or the shank portion.

29. The drill bit assembly of claim 26, wherein the downhole logging device is in communication with a downhole network.

30. The drill bit assembly of claim 26, wherein the shaft is a protrusion formed in the working portion of the assembly.

31. The drill bit assembly of claim 26, wherein the end of the shaft is substantially coaxial with a central axis of the drill bit assembly.

32. The tool string of claim 26, wherein the downhole logging device comprises a source of electric current source.

33. The tool string of claim 26, wherein the downhole logging device comprises an acoustic wave source.

34. The tool string of claim 26, wherein the downhole logging device comprises nuclear source.

* * * * *